US007311270B2

(12) United States Patent
Kapila

(10) Patent No.: US 7,311,270 B2
(45) Date of Patent: Dec. 25, 2007

(54) DEVICE AND METHODOLOGY FOR IMPROVED MIXING OF LIQUIDS AND SOLIDS

(75) Inventor: Mukesh Kapila, The Woodlands, TX (US)

(73) Assignee: M-I L.L.C., Houston, TX (US)

( * ) Notice: Subject to any disclaimer, the term of this patent is extended or adjusted under 35 U.S.C. 154(b) by 128 days.

(21) Appl. No.: 11/020,891

(22) Filed: Dec. 22, 2004

(65) Prior Publication Data

US 2005/0189081 A1 Sep. 1, 2005

Related U.S. Application Data

(60) Provisional application No. 60/532,159, filed on Dec. 23, 2003.

(51) Int. Cl.
*A62C 31/00* (2006.01)
*F23D 11/16* (2006.01)
*B05B 7/06* (2006.01)

(52) U.S. Cl. ..... 239/398; 239/419; 239/419.5; 239/427; 239/427.3; 239/428.5

(58) Field of Classification Search ..... 239/398, 239/419, 419.5, 422, 426, 427, 427.3, 428.5, 239/344, 354
See application file for complete search history.

(56) References Cited

U.S. PATENT DOCUMENTS 4,519,423 A 5/1985 Ho et al.
4,590,057 A * 5/1986 Hicks ..... 423/477
5,664,733 A 9/1997 Lott
5,799,831 A * 9/1998 Spriggs et al. ..... 222/132
6,000,839 A * 12/1999 Lott ..... 366/181.5
6,328,226 B1 * 12/2001 Goenka et al. ..... 239/290
6,974,546 B2 * 12/2005 Wood ..... 210/750

* cited by examiner

*Primary Examiner*—Davis Hwu

(57) ABSTRACT

An eductor for mixing liquids and solid particles includes a nozzle, an initial mixing chamber, a first diffuser, an intermediate mixing chamber and a second diffuser. The nozzle includes a semicircular nozzle outlet that is offset from a centrally-located first axis. Motive flow is accelerated through the nozzle through a first and second acceleration segment. Solid particles are added to the motive flow in the initial mixing chamber and directed to the first diffuser. Each diffuser includes an acceleration and a deceleration segment separated by an elliptically-shaped throat. The intermediate mixing chamber is located between the first and second diffusers. A method for mixing liquids and solids includes introducing a motive flow into an initial mixing chamber, creating a vacuum in the initial mixing chamber to induce solids into the motive fluid, providing a region of turbulence to enhance mixing of the motive flow and solid particles, and diffusing the motive flow to further increase boundary flow separation conducive to mixing.

12 Claims, 10 Drawing Sheets

DEVICE AND METHODOLOGY FOR IMPROVED MIXING OF LIQUIDS AND SOLIDS

This application claims priority to U.S. Provisional application 60/532,159 filed on Dec. 23, 2003, entitled "Device and Methodology for Improving Liquid/Solid Mixing," hereby incorporated by reference.

BACKGROUND OF INVENTION

Efficient mixing of fluids and solids is essential for many industry sectors. The means by which this mixing is undertaken are many, the choice of which is dependent upon the nature of the materials being mixed and the degree and rate of mixing required.

Numerous concepts and frequent efforts have been made to improve the efficiency and effectiveness of liquid and solid mixing systems. Several notable methods that have met with relative success, depending upon the nature of the materials being mixed, have included: nozzle geometry distortion, motive flow pulsation, and the introduction of a diffuser as part of the system.

Nozzle distortion attempts to create turbulent flow by altering the geometry of the interaction of the motive flow with the nozzle surface, as shown in FIGS. 1*a* and 1*b*. The result of such an alteration is to change the velocity of the motive fluid as it exits the outlet of the nozzle creating vortices in which liquid-liquid or liquid-solid mixing can occur. Referring to FIG. 2*a*, typical geometries generate a narrow circular or near circular jet 300 that minimizes solids entrainment, hence minimizing the mixing effectiveness of liquid-liquid or liquid-solid vortices. As shown in FIGS. 2*a-d*, nozzle distortions 300 will quickly decay and eventually return to a circular or near circular shape. In addition, when solids 310 are introduced from the top by gravity into a larger cavity containing the liquid jet stream 300, only a small portion of the solids make contact with the liquid.

Referring to FIG. 3, a fluid velocity profile is shown for a prior art nozzle. The liquid jet stream 300 emanating from the initial mixing chamber reaches an upper range of 53.6 to 67.0 ft/sec, depicted as reference 320. As can be seen, this high velocity pierces through the solids that are introduced from above. Slower fluid velocities in the range of 40.2 to 53.6 ft/sec are depicted as reference 322 and are present ahead of the higher velocity stream 320 and in a boundary layer around stream 320. The fluid velocity slows even more downstream to a range of 26.8 to 40.2 ft/sec as depicted by reference 324. Upon entrance to the constricted area 312, and the diverging area 314, the velocity is slower, in the range of 13.4 to 26.8 ft/sec, shown by reference 326. It is in this entrance to the constricted area 312 that the velocity profile shows a single mixing zone 330. The slowest velocity, 0.00 to 13.4 ft/sec, shown by reference 328, is present along the edges of diverging area 314 as well as in initial mixing chamber where solids 310 are added at an angle normal to, or nearly normal to, the direction of fluid through the nozzle.

In motive flow pulsation, pulsating the velocity of the motive flow, either with or without a nozzle, does change the velocity that creates turbulent flow, but will not permit the maintenance of a vacuum conducive to consistent and rapid induction of the secondary solid. Furthermore, such efforts require additional control systems and external energy reducing the efficiency of the process.

A third methodology which has seen more positive results is that of the motive flow utilizing the combination of nozzle and diffuser. This combination is referred to as an eductor. The relative velocity of the motive flow passing through the void on the outlet of the nozzle effectively maintains the vacuum required to permit induction of the secondary solids, but does not create recirculation zones sufficient in size and intensity to permit optimal mixing.

The action of the motive flow through the nozzle into the void space at the outlet of the nozzle carries the secondary solid into the eductor but does not succeed in mixing the two to any great extent. All nozzle geometries create vortices at the micro level downstream of the nozzle. It has been suggested that some nozzle geometries, such as lobed nozzles, can create these vortices faster (i.e. at a lower pipe diameter lengths) for liquid in liquid applications. However, the intensity of the vortices does not change and applications to induced solids in liquid are unknown._ Furthermore the speed at which the micro vortices are created in eductor based liquid-solid mixing applications is not critical as several pipe diameters are available prior to discharge.

The creation of a vacuum to induce solids into the motive fluid and large eddy current vortices is necessary to entrain and mix the solids with the motive fluid. Therefore, without the addition of a downstream diffuser which is used to create vacuum and create short and intense large eddies, mixing is limited and solids are simply carried along the plane of the motive flow only to be inefficiently mixed several pipe diameters downstream at a very slow rate.

One effective method of controlling the location of large eddies and recirculation mixing zones created between the nozzle outlet and the diffuser inlet is through nozzle and diffuser geometry and position. Through the combination of these geometries and positions, several large eddies are generated that maximize solids induction and solid-liquid interface while limiting pressure drop. Typically, nozzles with or without distorted geometries are placed in the center of the motive flow and produce only limited contact with the solids and motive fluid. Therefore the turbulence and consequent mixing along the linear axis of the motive flow are limited. Further, protruding nozzles can be an impediment to the induction of the solids. Such an impediment will reduce the induction rate and negatively impact mixing performance.

This problem has been addressed with the introduction of a multi-lobed circular nozzle in conjunction with a lightly tapered single throat diffuser. While effective, this concept can be improved upon in such a manner so as to increase the rate at which secondary solids can be induced into the motive flow, improving the solids-liquid surface contact through a flat profile jet stream, improve the generation of three large eddy currents through the use of diffuser geometry, maintain turbulent flow throughout the mixing body through nozzle and diffuser geometry, increase and maintain the vacuum which facilitates the rapid induction of solids, reduce the pressure loss through the eductor system through nozzle geometry and improve overall mixing performance as measured by rate of hydration of secondary solids.

SUMMARY

In one aspect, the claimed subject matter is generally directed to an improved in-line liquid/solid nozzle. The present invention provides an improved fluid mixing nozzle that achieves one or more of the following: accelerates the motive fluid; provides improved mixing of fluids and secondary solids; utilizes a unique semicircular nozzle geometry; improves the vacuum in the void between the nozzle outlet and diffuser inlet; improves the rate of induction of secondary solid; allows the use of a shorter diffuser section ; utilizes a diffuser section with non-uniform diffuser inlet angles; utilizes a diffuser with a primary mixing zone plus two additional mixing zones in the diffuser; improves pre-wetting of solids in the primary mixing zone; creates a turbulent flow zone; induces macro and micro vortices in the motive flow; improves rate of hydration of solids; increases motive flow rates through the nozzle; permits consistent performance with low or inconsistent line pressure; reduces pressure drop through the eductor, in addition to other benefits that one of skill in the art should appreciate. The eductor includes a nozzle, an initial mixing area, and a segmented diffuser. The nozzle is a semi-circular orifice that is off-center from a central axis. The nozzle outlet feeds motive flow into the initial mixing area. The solid material is also directed into the initial mixing area. The initial mixing area is of a size sufficient to create a temporary vacuum within the area, enhancing mixing in this first mixing zone. From the initial mixing area, the combined motive flow and entrained solid are fed into the segmented diffuser. The diffuser has two segments, the first of which contains a sloped inlet converging to a throat and a sloped outlet diverging to an intermediate cavity. The diffuser throat is elliptical, consistent with the shape of the jet stream. The second segment inlet is also sloped, converging to a throat while the outlet is sloped, diverging to the eductor outlet. The intermediate cavity serves as a second mixing zone, while the exit of the second diffuser serves as a third mixing area.

Another illustrated aspect of the claimed subject matter is a method for liquid/solid mixing. A liquid fluid acting as a motive flow passes through a nozzle into a void. The motive flow through the nozzle into the void creates a temporary vacuum, which permits the enhanced induction of a separate solid entrained into the motive flow external to the nozzle. The flat profile of the jet stream allows for improved entrainment of solids. A large turbulent region having turbulent intensity at minimal pressure loss is produced by the nozzle. This region of turbulence is conducive to mixing the motive flow and the induced solid. The motive flow carries the induced solid into the diffuser section. In each of the diffuser cavities, large eddy currents and recirculation mixing zones are created as velocity increases and boundary flow separation occurs. In these recirculation mixing zones and diffuser convergent sections, there exists areas of turbulent flow conducive to mixing. The mixed fluid is discharged from the diffuser unit.

Other aspects and advantages of the claimed subject matter will be apparent from the following description and the appended claims.

DETAILED DESCRIPTION

Figure 7:
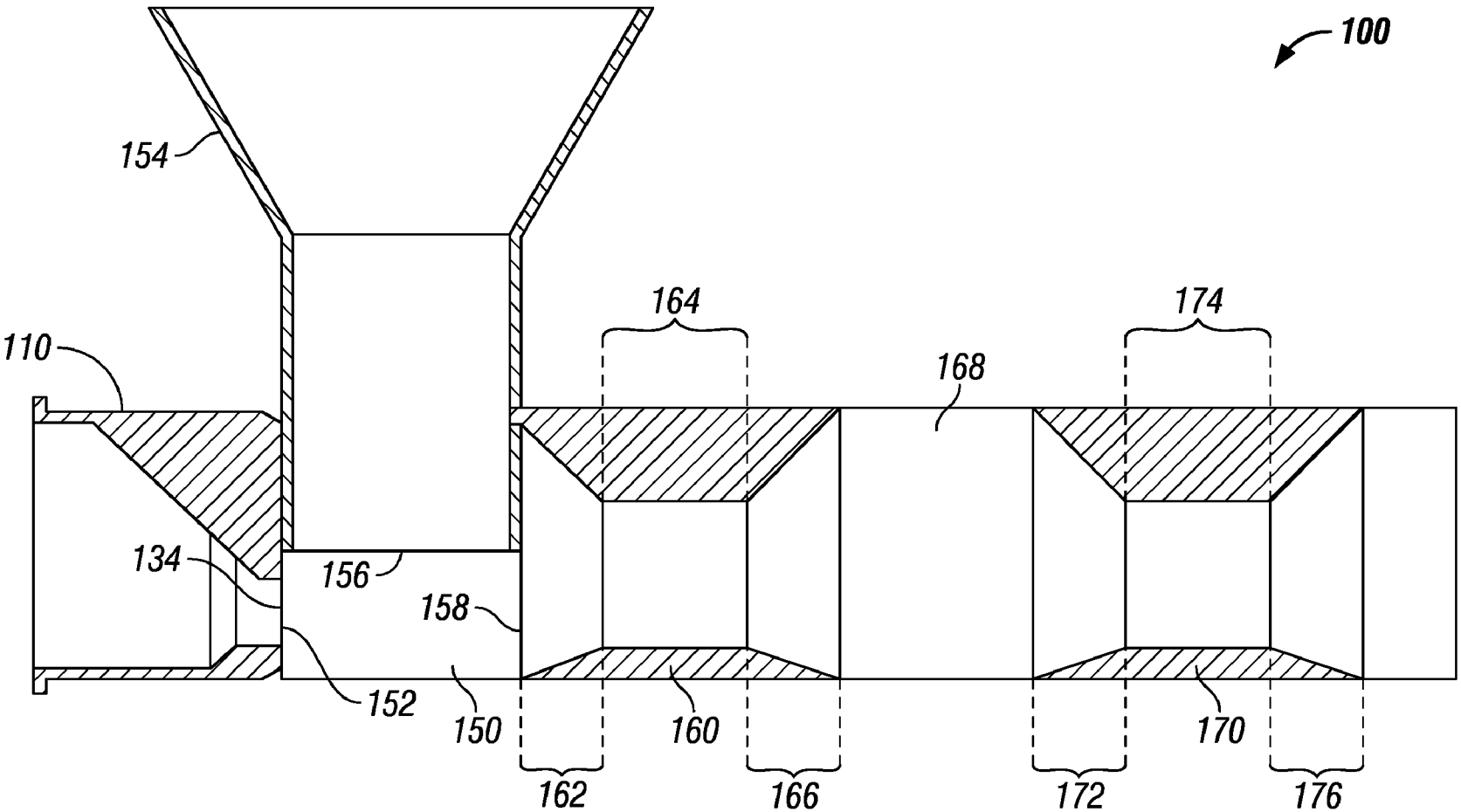
FIG. 7 is a cutaway side view of a mixing apparatus including the nozzle.

The claimed subject matter relates to a eductor 100 and a method for mixing liquids with solids. Referring to FIG. 7, the eductor 100 includes a nozzle 110, an initial mixing chamber 150, a hopper 154, a first diffuser 160, an intermediate mixing chamber 168, and a second diffuser 170.

Figure 1A:
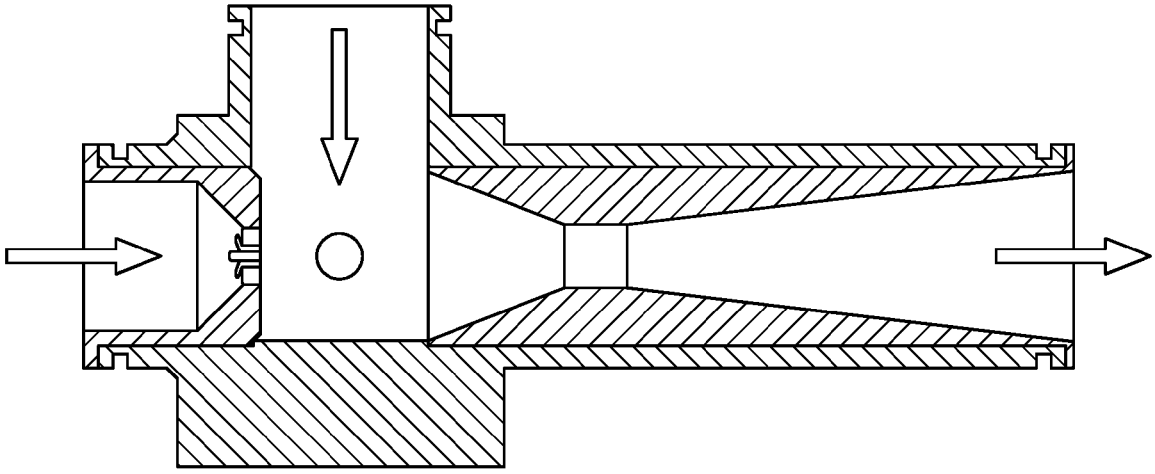
FIG. 1a (Prior Art)
FIGS. 1*a* and 1*b* are views of a prior art nozzle.
Figure 1B:
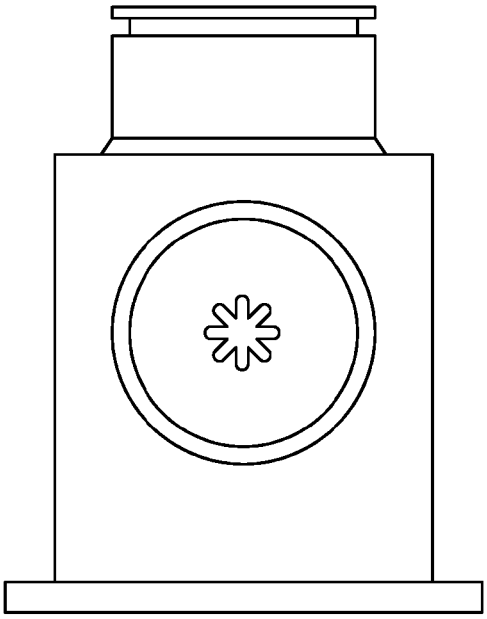
FIG. 1b (Prior Art)
Figure 2A:
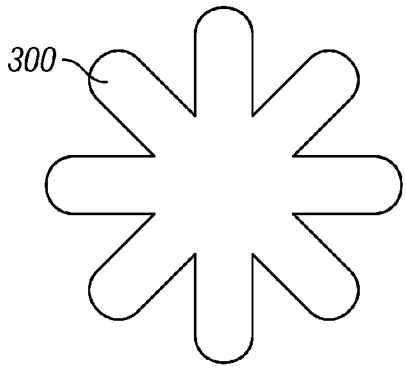
FIG. 2a (Prior Art)
FIGS. 2*a* through 2*d* are contours of volume fractions of solids through a prior art nozzle.
Figure 2B:
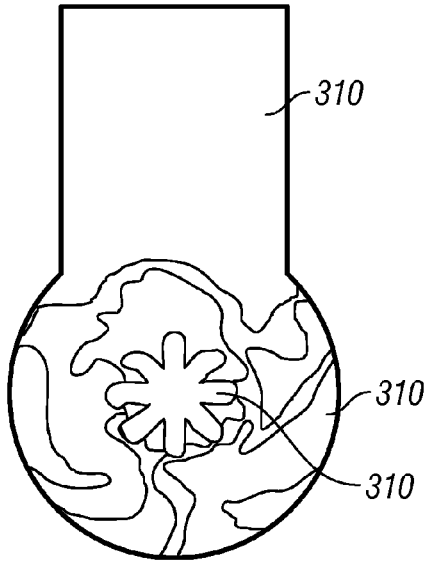
FIG. 2b (Prior Art)
Figure 2C:
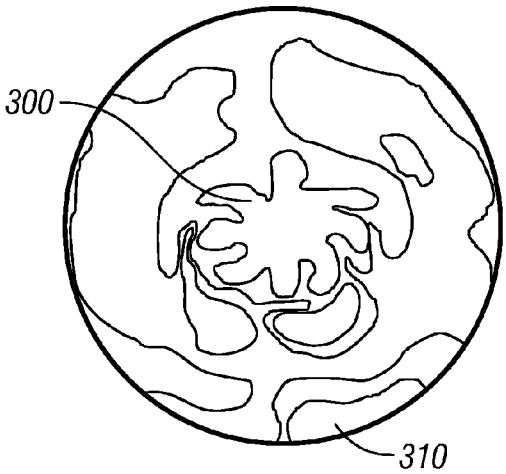
FIG. 2c (Prior Art)
Figure 2D:
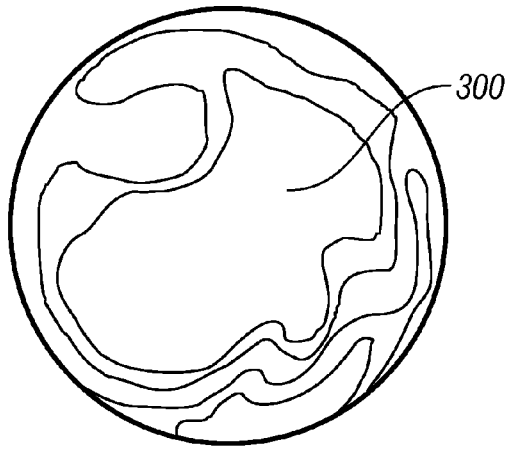
FIG. 2d (Prior Art)
Figure 3:
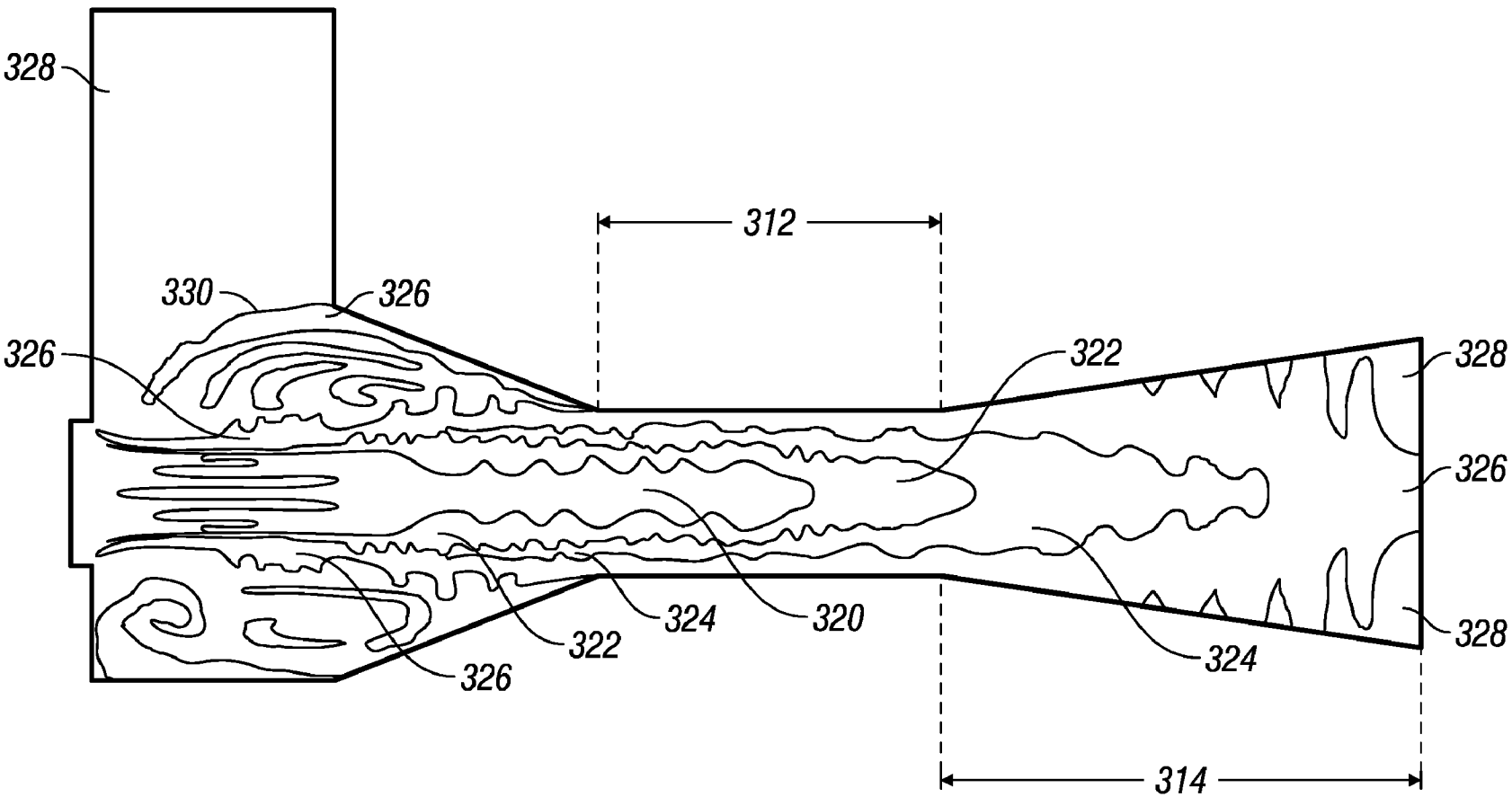
FIG. 3 (Prior Art)
FIG. 3 is a computer-generated velocity profile of fluid through a prior art nozzle and downstream addition of a solid.
Figure 4:
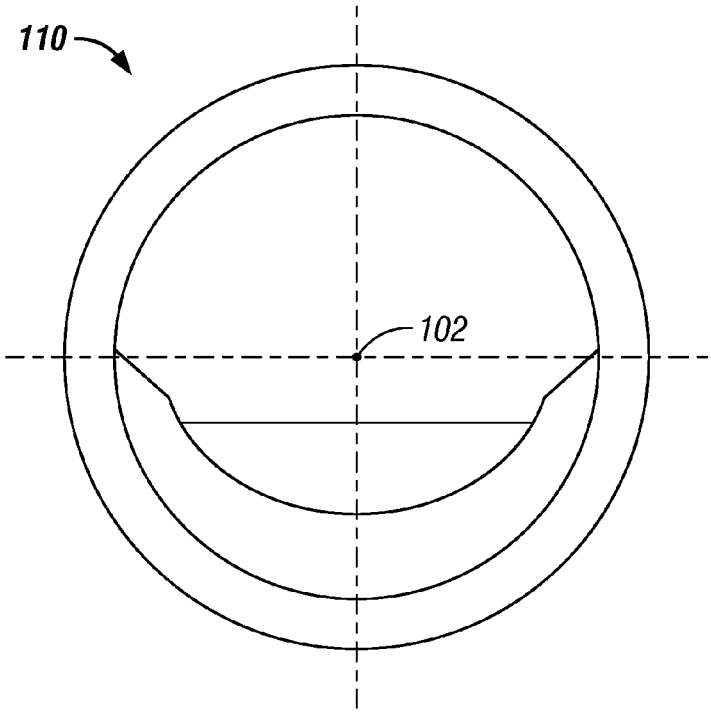
FIG. 4 is a back view of the inventive nozzle.
Figure 6:
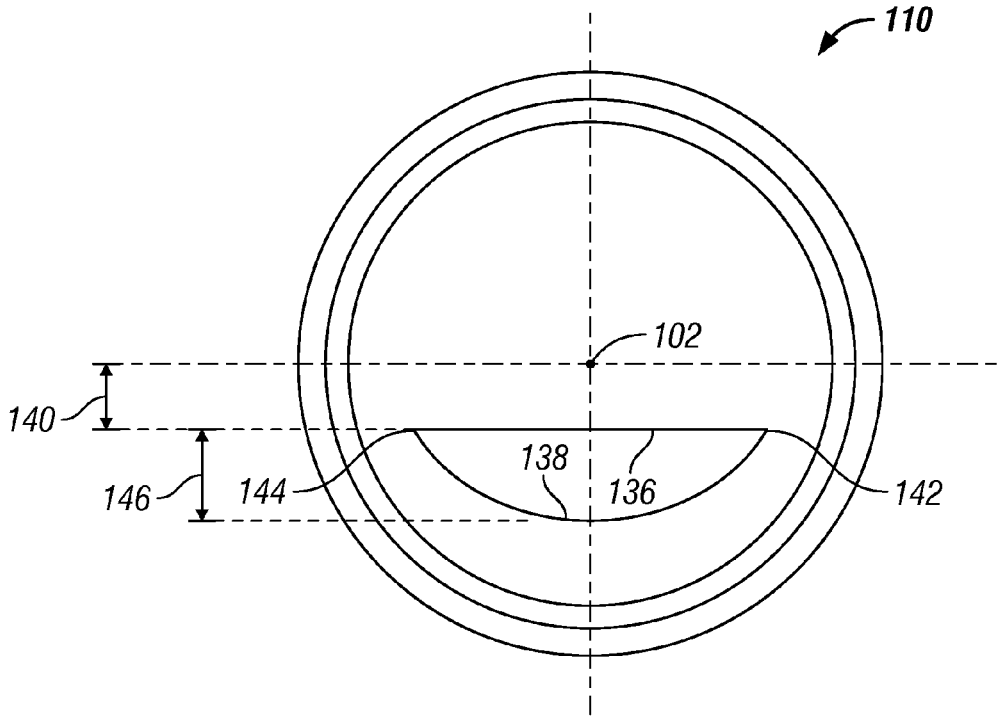
FIG. 6 is a front view of the inventive nozzle.
Figure 5:
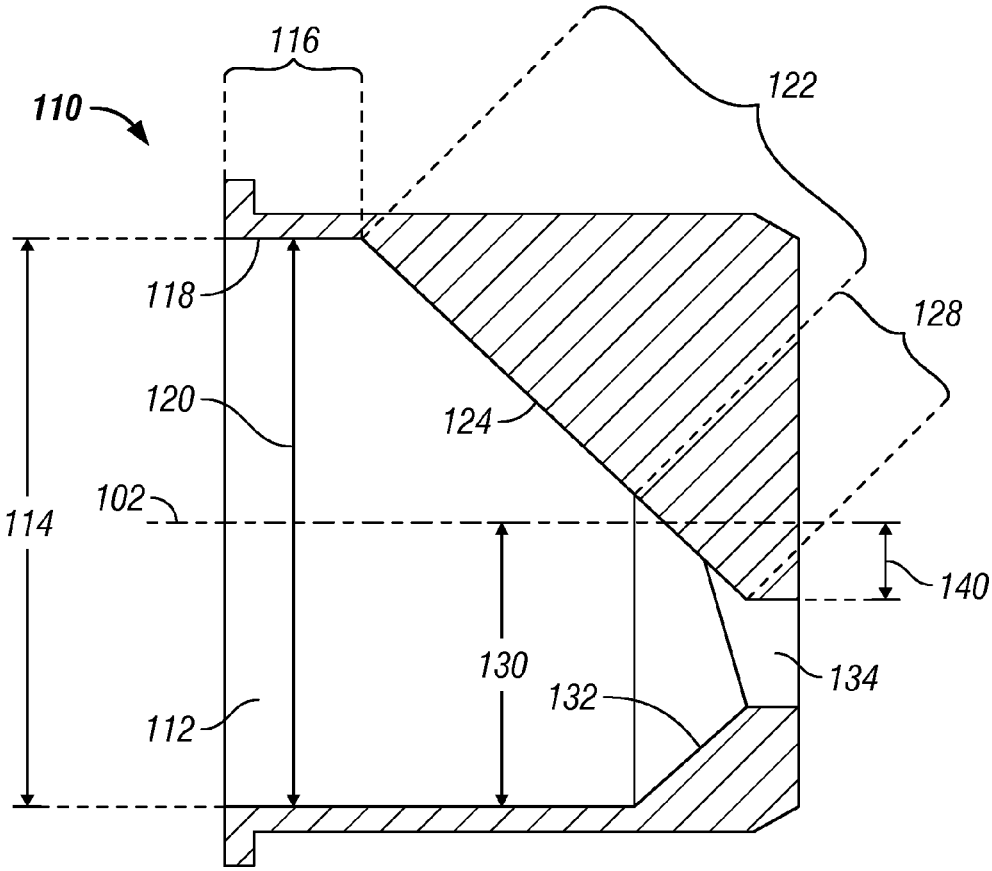
FIG. 5 is a cutaway side view of the inventive nozzle.

Turning to FIGS. 4-6, three views of an embodiment of nozzle 110 are depicted. A motive flow is introduced into initial mixing chamber 150 through nozzle 110. A nozzle inlet 112 is circular about a first axis 102 and has a nozzle inlet diameter 114. In an entrance segment 116 of nozzle 110, the inner surface 118 has an inner diameter 120, which is equal to nozzle inlet diameter 114. Nozzle 110 has a nozzle outlet 134, wherein an upper outlet edge 136 is flat and a lower outlet edge 138 is semicircular. The upper and lower outlet edges 136 and 138 share common side points 142 and 144 and lower outlet edge 138 extends nozzle outlet height 146 from upper outlet edge 136 at the lowest point. The upper outlet edge 136 is offset from first axis 102 by an offset distance 140. Between nozzle inlet 112 and nozzle outlet 134, a first acceleration segment 122 is defined by a gradually reducing cross sectional area, wherein an upper portion 124 of inner surface 118 gradually flattens and slopes toward a plane that is offset distance 140 below first axis 102, aligned with upper outlet edge 136. In a second acceleration segment 128 of nozzle 110, the radial length 130 between a lower portion 132 of the inner surface 118 and the first axis 102 also decreases to match the shape of the lower outlet edge 138.

Figure 11:
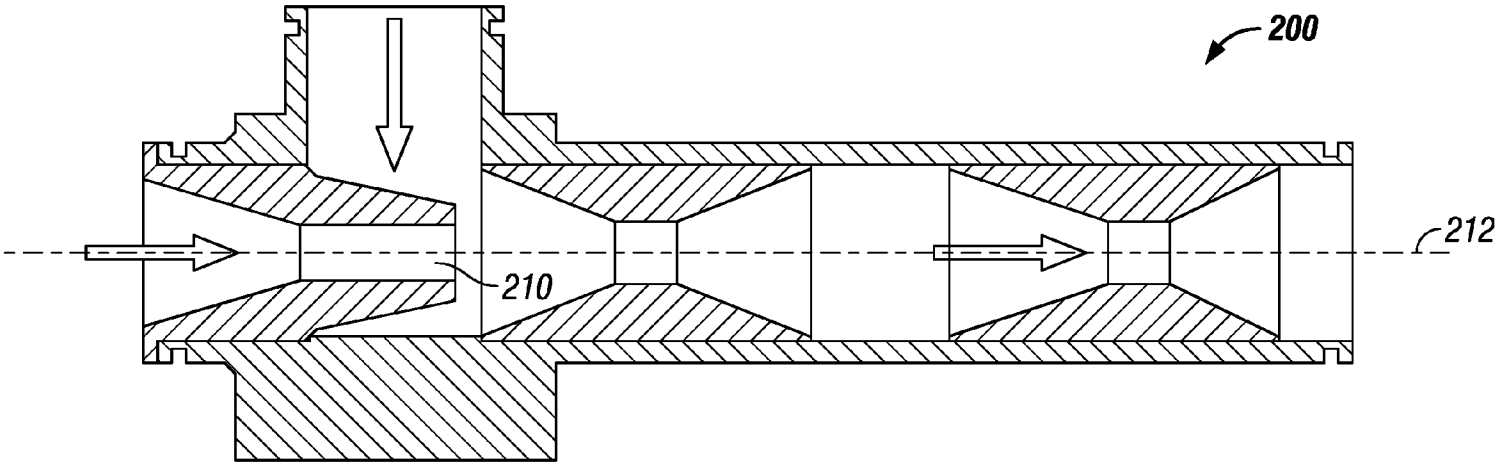
FIG. 11 is a side view of a prior art nozzle.
Figure 12:
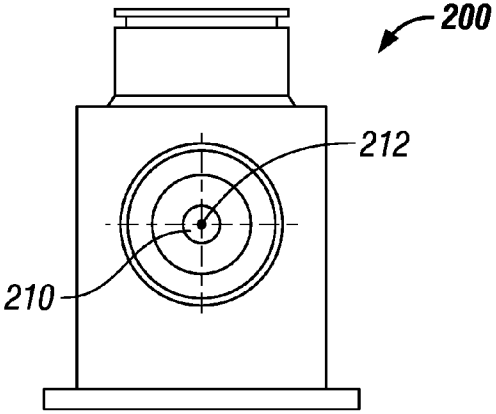
FIG. 12 is a front view of a prior art nozzle.

A standard round nozzle 200 may be incorporated into eductor 100 instead of nozzle 134. As shown in FIGS. 11 and 12, round nozzle 200 has an outlet 210 that is circular about a nozzle axis 212. When inert solids, such as bentonite, are mixed with a fluid, the semicircular nozzle 134 may be used. As will be discussed, when more active and partially hydrophilic solids, such as polymers, are added to a fluid, round nozzle 200 is preferred.

Figure 9:
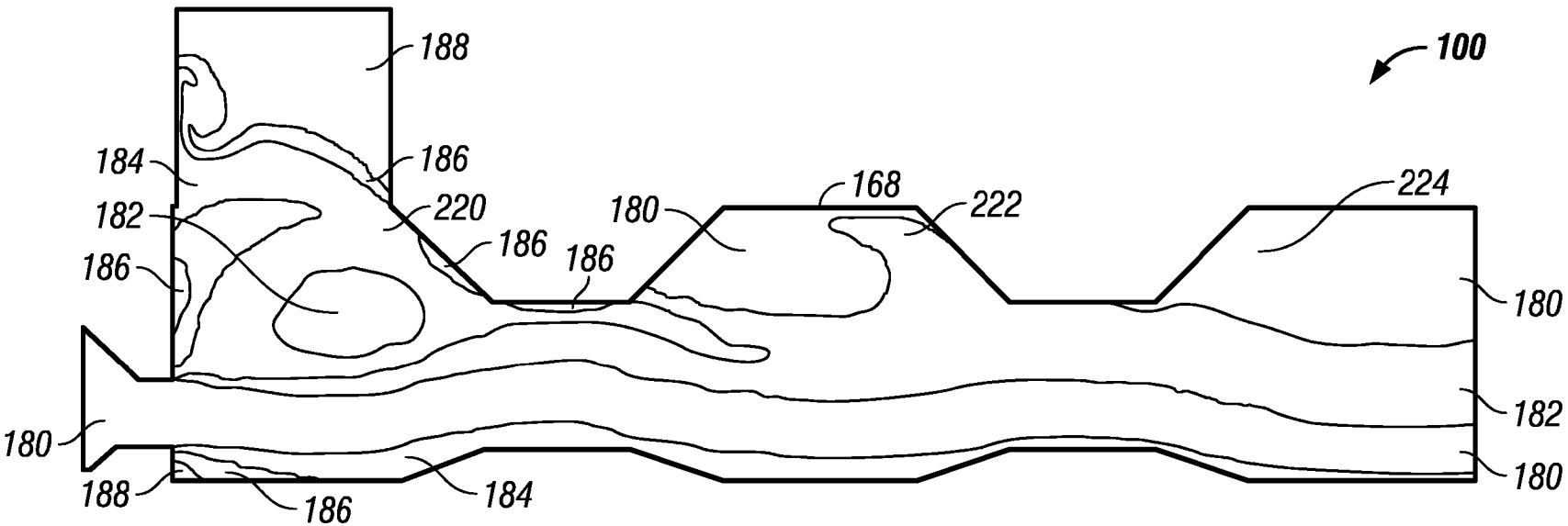
FIG. 9 is a side view of the contour of volume fraction of solid particles through the eductor.
Figure 10:
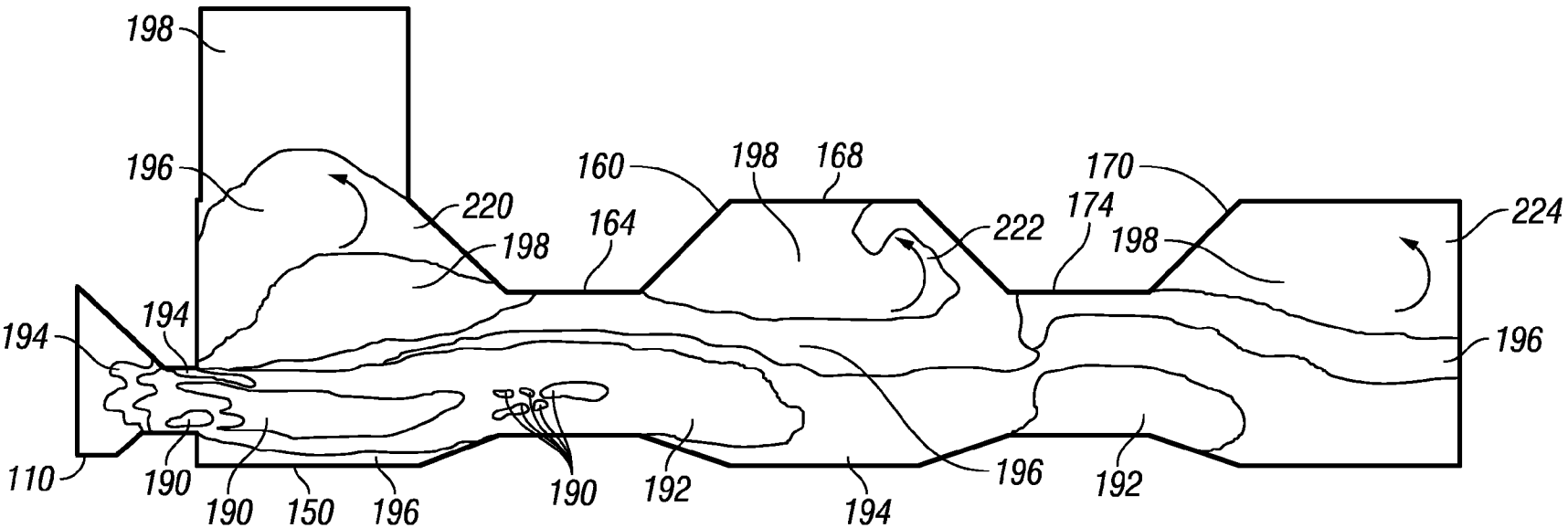
FIG. 10 is a computer-generated velocity profile of fluid through the inventive eductor with solid particles added downstream from the nozzle.

Returning to FIG. 7, initial mixing chamber 150 receives both motive flow and solid particles. The motive flow is received from nozzle outlet 134 or 210 through a chamber first inlet 152 while the solid particles are received from hopper 154 through a chamber second inlet 156. A first mixing zone 220, shown in FIGS. 9 and 10, is created within initial mixing chamber 150. When semicircular nozzle 134 is used to direct fluid into initial mixing chamber 150, first mixing zone 220 is more turbulent than when round nozzle 210 is used to direct fluid into the initial mixing chamber 150. First mixing zone 220 often extends into chamber second inlet 156 when semicircular nozzle 134 is used, due to the fluid velocity created by nozzle 134. For this reason, when active and partially hydrophilic solids are added to the motive flow, the round nozzle 210 is preferred to minimize the fluid entry to and the build up of solid particles within chamber second inlet 156. When more inert solid particles are added to the motive flow, semicircular nozzle 134 may be used.

A chamber outlet 158 directs the initial mixture of motive flow and solid particles into the diffuser segments of the eductor 100. Chamber outlet 158 is aligned with nozzle outlet 134, thereby minimizing energy lost by the motive flow as the solid particles are received into initial mixing chamber 150 at an angle substantially normal to stream of the motive flow.

Chamber outlet 158 feeds the initial mixture into a first diffuser 160. First diffuser 160 includes a first converging section 162 and a first diverging section 166, between which is a first throat 164. First throat 164 has an elliptical cross-sectional shape (not shown), consistent with the shape of the jet stream. The converging and diverging sections 162, 166 of first diffuser 160 serve to induce turbulence into the flow, enhancing the mixing of the motive flow and solid particles.

The first diverging section 166 feeds the initial mixture into intermediate mixing chamber 168, which is in alignment with the first diffuser 160. Within intermediate mixing chamber 168, a second mixing zone 222, shown in FIGS. 9 and 10, is created by eddies forming therein prior to the motive fluid and solid particles being directed further downstream.

From the intermediate mixing chamber 168, the intermediate mixture is fed into a second diffuser 170. The second diffuser 170 is similar to the first diffuser 160, having a second converging section 172, a second throat 174, and a second diverging section 176. Additional mixing is enhanced by the turbulence created by the second diffuser 170. Downstream from second diffuser 170, a third mixing zone 224 forms, as shown in FIGS. 9 and 10, causing additional mixing of the fluid and the solids.

Figure 8A:
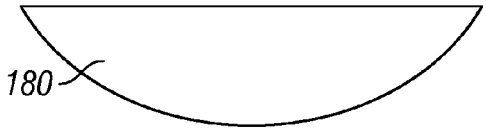
FIGS. 8*a* through 8*d* are contours of volume fractions of solid particles through the eductor.
Figure 8B:
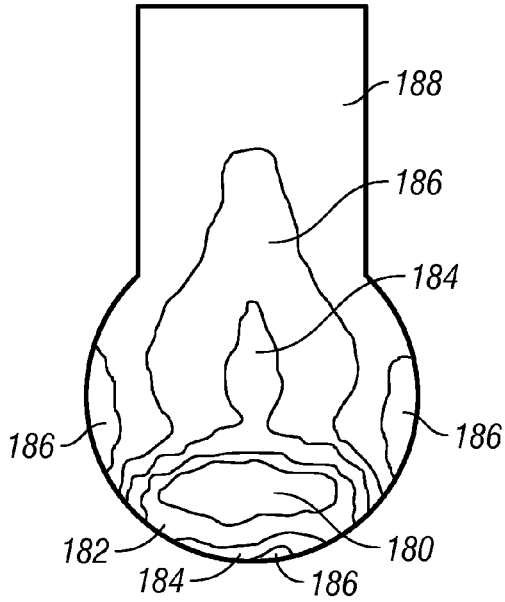

Referring to the cross-sectional views of the flow through the eductor 100 shown in FIGS. 8*a*-8*d*, the extent of mixing at points throughout the eductor 100 may be seen. FIG. 8*a* shows the contour of motive flow fluid 180 coming through the nozzle outlet 134 (shown in FIG. 5). Such fluid is virtually solids-free and is denoted as reference 180 throughout this description. The addition of solids from hopper 154 to the motive flow is shown in FIG. 8*b*, with reference number 188 denoting a cross-sectional area that is primarily solids. It is understood by one skilled in the art that there may be a traces of solids in the fluid 180 throughout the eductor 100 while there may be traces of fluids in the areas that are primarily solids 188.

For this description, additional increments of the mixture between the solids-free fluid 180 and the solids 188 are included. Reference 184 refers to a mixture, wherein the solids are effectively entrained in the fluid. Boundary layers of ineffectively mixed fluid 182 and ineffectively mixed solids 186 are also depicted.

In FIG. 8*b*, it can be seen that an area of effective mixing 184 has begun to form centrally between the solids-free fluid 180 and the solid particles 188. A boundary layer of ineffectively mixed solids 186 is located around the area of effective mixing 184 while a boundary layer of ineffectively mixed fluid is located below the solids-free fluid 180.

Figure 8C:
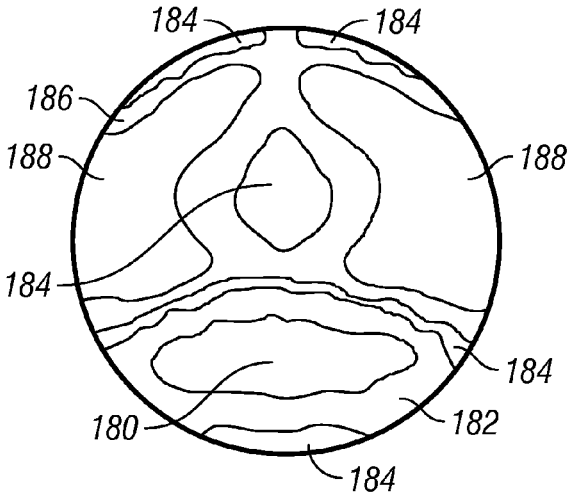

Referring to FIG. 8*c*, the areas of effective mixing 184 include the area toward the center of the cross sectional area and above the fluid stream 180 emanating from the nozzle 110. Primarily solid particle streams 188 are present along the sides of the cross sectional area. Other boundary layers of effectively mixed fluid 184 are present at the top and bottom of the cross sectional area and around the solids-free fluid stream 180. Boundary layers of ineffectively mixed solids 186 are present around the solid particle streams 188.

Figure 8D:
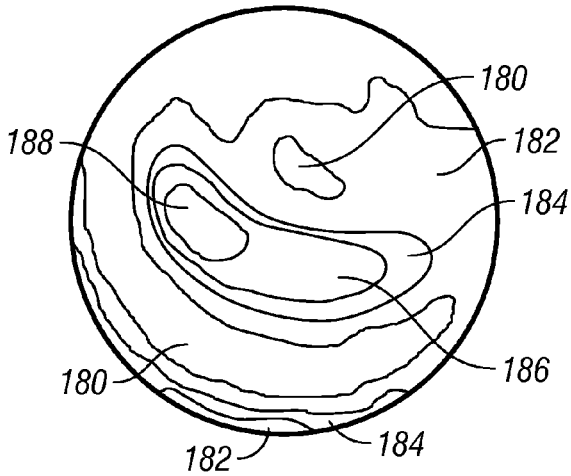

Referring to FIG. 8*d*, the solids free fluid stream 180 has been elongated around much of the cross-sectional area. The solid particle stream 188 has merged into a single stream that is slightly off-center. A boundary layer of ineffectively mixed solids 186 surround the solid particle stream 188. A ring of effectively mixed fluid 184 surrounds the ineffectively mixed solids 186. A boundary layer of ineffectively mixed fluid 182 is between the boundary layer of effectively mixed fluid 184 and the solids-free fluid 180.

Referring to FIG. 9, it can be seen more clearly that the solid particle stream 188 and the solids-free fluid stream 180 are mixed in the initial mixing chamber 150. Downstream, the solids-free layer 180 gradually decreases in height and flows near the bottom of the eductor 100. Further mixing eddies can be seen in intermediate mixing chamber 168.

The computer-generated water velocity profile, shown in FIG. 10, has several ranges of fluid velocity depicted. Reference 190 depicts fluid velocity in the range of about 33.1 to 41.4 ft/sec. The range depicted by 190 includes the fluid flow out of nozzle 110 and through initial mixing chamber 150. From the profile, it appears that the fluid velocity remains in this higher range until into first throat 164. The velocity range depicted by reference 192 is about 24.9 to 33.1 ft/sec. The range shown by reference 192 is in a boundary layer around range 190 as well as in second throat 174. Reference 194 shows fluid velocity in the range of 16.6 to 24.9 ft/sec. Range 194 is present in a boundary layer around range 192 and through first diffuser 160, intermediate mixing chamber 168 and second diffuser 170. The fluid velocity range depicted by 196 is in the range of 8.29 to 16.6 ft/sec, which is primarily in mixing eddies of the initial mixing chamber 150 and the intermediate mixing chamber 168, as well as downstream of second diffuser 170. Fluid velocity in the range of 0.0164 to 8.29 ft/sec. is shown as reference 198 and is in the area where solid particles are added at an angle at or nearly normal to direction of fluid flow from nozzle 110. The slower fluid velocities 194, 196, 198 through first diffuser 160, intermediate mixing chamber 168 and second diffuser 170 help enhance mixing of the liquid and solids by creating turbulence.

Test

A test was conducted using a variety of powdered materials representative of solids that would be mixed with base liquid to form a drilling mud. The same hopper was utilized with the exception that the mixing nozzles indicated were used. Bentonite, polyanionic cellulose, and XC polymer were each introduced to the base liquid through the various nozzles. Such particles are representative of other particles having the same or similar densities.

Rheological properties of the resulting drilling muds were measured and recorded. Such properties included fisheyes, yield point, and funnel viscosity. Fisheyes are known by those of skill in the art to be a globule of partly hydrated polymer caused by poor dispersion during the mixing process. The yield point is the yield stress extrapolated to a shear rate of zero. The yield point is used to evaluate the ability of a mud to lift cuttings out of the annulus of the well hole. A high yield point implies a non-Newtonian fluid, one that carries cuttings better than a fluid of similar density but lower yield point. The funnel viscosity is the time, in seconds for one quart of mud to flow through a Marsh funnel. This is not a true viscosity, but serves as a qualitative measure of how thick the mud sample is. The funnel viscosity is useful only for relative comparisons. The comparison of each of these rheological properties may be seen in Table 1 below:

| Rheological Properties | | | | | | | | | | |
|---|---|---|---|---|---|---|---|---|---|---|
| | Fisheyes | | | Yield Point | | | LSRV | Funnel Viscosity | | |
| Nozzle | Bentonite lb/100 bbl | PAC lb/100 bbl | XCD lb/100 bbl | Bentonite YP | PAC YP | XCD YP | XCD cp | Bentonite sec | PAC sec | XCD sec |
| Invention | 14 | 66 | 1.9 | 6 | 28 | 11 | 6,599 | 31 | 112 | 35 |
| Prior Art #1 | 22 | 56 | 0.1 | 4 | 26 | 13 | 3,399 | 34 | 86 | 35 |
| Prior Art #2 | 109 | 2 | 0.6 | 4 | 45 | 7 | 1,700 | 18 | N/A | 33 |
| Lab | | | | 6 | 57 | 67 | | | | |

As can be seen, the fisheyes in the mud made from bentonite mixed with the inventive nozzle weighed less per volume than that mixed with the prior art nozzles. Further, the mud yield point was higher than the mud mixed with the prior art nozzles.

Mechanical properties of the resulting drilling muds were also measured and recorded. These properties included mixing energy, pressure drop, motive flow, vacuum, and solids induction.

| Mechanical Fluid Properties | | | | | |
|---|---|---|---|---|---|
| Nozzle | Mixing Energy kW/m3/hr | Pressure Drop psi | Motive Flow gpm | Vacuum in of Hg | Solids Induction lb/hr |
| Invention | 95 | 49.2 | 578 | 26.6 | 25,992 |
| Prior Art #1 | 106 | 55.7 | 515 | 21.5 | 26,173 |
| Prior Art #2 | 110 | 57.3 | 488 | 16.5 | 13,846 |

From the table, it is seen that the eductor 100 can entrain nearly the same volume of solids per hour into the motive stream at a lower mixing energy than the prior art mixer.

A method of mixing solid particles with a motive flow includes introducing a motive fluid to an initial mixing chamber 150. This may be done through the nozzle 110, previously described. Inside initial mixing chamber 150, a vacuum is created by the motive flow. Solids are introduced into initial mixing chamber 150 and are induced into the motive fluid by the vacuum that has been created. A region of turbulence is provided to initially mix the motive flow and the induced solids. The motive flow, now carrying the induced solids is diffused to further entrain the solid particles. The initial mixture is further mixed in an intermediate mixing chamber. The intermediate mixture is then diffused again to provide additional turbulence to enhance mixing. Prior to each diffusion, the mixture may be subjected to an increased flow rate by reducing the cross sectional area through which the mixture flows.

While the claimed subject matter has been described with respect to a limited number of embodiments, those skilled in the art, having benefit of this disclosure, will appreciate that other embodiments can be devised which do not depart from the scope of the claimed subject matter as disclosed herein. Accordingly, the scope of the claimed subject matter should be limited only by the attached claims.

What is claimed is:

1. An apparatus for mixing solids and liquids comprising:

a nozzle having a nozzle inlet and a nozzle outlet;

wherein the nozzle outlet is semicircular, and wherein the round inlet is centered about a first axis and the nozzle outlet is offset from the first axis;

wherein the nozzle outlet further comprises:

a flat upper outlet edge located an offset distance below the first axis; and a semicircular lower edge sharing common side points with the upper edge and defining an opening therebetween having a nozzle outlet height;

an initial mixing chamber receiving fluid from the nozzle and having a chamber first inlet, a chamber second inlet, and a chamber outlet;

a hopper operable to provide solid particles to the initial mixing chamber through the chamber second inlet;

a first diffuser receiving a mixture of the fluid and solid particles from the initial mixing chamber and having a first diffuser inlet, a first diffuser throat, and a first diffuser outlet;

an intermediate mixing chamber receiving the mixture from the first diffuser; and a second diffuser receiving the mixture from the intermediate mixing chamber and including a second diffuser inlet, a second diffuser throat, and a second diffuser outlet.

2. The apparatus as in claim 1, wherein the nozzle further comprises:

an inner surface extending from the nozzle inlet to the nozzle outlet;

a first acceleration segment, wherein an upper portion of the inner surface slopes downward and flattens toward a plane coextensive with the upper outlet edge; and a second acceleration segment, wherein a lower portion of the inner surface slopes upward and inward to match the lower edge of nozzle outlet.

3. The apparatus of claim 1, wherein the first diffuser throat and the second diffuser throat have an elliptical cross sectional shape.

4. The apparatus of claim 1, wherein the first diffuser further comprises:

a first converging section between the first diffuser inlet and the first diffuser throat; and a first diverging section between the first diffuser throat and the first diffuser outlet.

5. The apparatus of claim 4, wherein the second diffuser further comprises:

a second converging section between the second diffuser inlet and the second diffuser throat; and a second diffusing section between the second diffuser throat and the second diffuser outlet.

6. An eductor for mixing solid particles into a motive fluid comprising:

a nozzle having a nozzle inlet and a nozzle outlet;

an initial mixing chamber, receiving motive flow from the nozzle and receiving solid particles, wherein a first mixing zone is formed within the initial mixing chamber to combine the motive fluid and the solid particles into an initial mixture;

a first diffuser including a first converging segment, a first throat, and a first diverging segment serially aligned;

a second diffuser segment including a second converging segment, a second diverging segment, and a second throat serially aligned;

an intermediate mixing chamber receiving the initial mixture from the first diffuser, wherein a second mixing zone is formed within the intermediate mixing chamber to further mix the initial mixture to provide an intermediate mixture of the motive fluid and the solid particles.

7. The eductor of claim 6, wherein the nozzle inlet is circumferential about a first axis and the nozzle outlet is semicircular, defined by a flat portion an offset distance from the first axis and a round portion distal the first axis.

8. The eductor of claim 6, wherein the nozzle further comprises:

an upper outlet edge located an offset distance below the first axis and extending in a straight line between opposing side points;

a lower outlet edge curving between the opposing side points of the upper outlet edge to define an opening having a nozzle outlet height.

9. An eductor as in claim 8, wherein the nozzle further comprises:

an entrance segment having an inner surface with an inner diameter;

a first acceleration segment in fluid communication with the entrance segment and having a top portion of the inner surface slope downward and flatten and a lower portion of the inner surface remain a constant radial distance from the first axis;

a second acceleration segment in fluid communication with the first acceleration segment and the nozzle outlet, wherein the top portion of the inner surface continues to slope downward and flatten to match the upper outlet edge below the first axis and the lower portion of the inner surface slopes upward to match the curve of the lower outlet edge.

10. The eductor of claim 6, wherein the first throat and the second throat each have an elliptically shaped cross section.

11. A method of mixing a solid and a liquid comprising:

introducing a motive fluid to an initial mixing chamber;

creating a vacuum to induce solids into the motive fluid;

providing a first mixing zone for mixing the motive fluid and the induced solids;

diffusing the motive fluid carrying the induced solids to increase boundary flow separation;

creating a second mixing zone to further mix the motive fluid with the solids;

diffusing the motive fluid a second time; and creating a third mixing zone to further mix the motive fluid with the solids.

12. A method of mixing a solid and a liquid comprising:

introducing a motive fluid to an initial mixing chamber;

creating a vacuum to induce solids into the motive fluid;

providing a first mixing zone for mixing the motive fluid and the induced solids;

diffusing the motive fluid carrying the induced solids to increase boundary flow separation;

creating a second mixing zone to further mix the motive fluid with the solids; and repeatedly diffusing the motive flow to create a plurality of mixing zones to further mix the motive fluid with the solids.

* * * * *